US006888077B2

(12) United States Patent
Garcia et al.

(10) Patent No.: US 6,888,077 B2
(45) Date of Patent: May 3, 2005

(54) ELECTROMAGNETIC PROTECTION AND CONTROL ASSEMBLY

(75) Inventors: José Garcia, Agey (FR); Serge Paggi, Ruffey les Echirey (FR); Régis Perrocheau, Couternon (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 129 days.

(21) Appl. No.: 10/460,406

(22) Filed: Jun. 13, 2003

(65) Prior Publication Data

US 2004/0047101 A1 Mar. 11, 2004

(30) Foreign Application Priority Data

Jun. 25, 2002 (FR) ..... 02 07963

(51) Int. Cl.[7] ..... H01R 11/09

(52) U.S. Cl. ..... 200/50.32; 200/284; 335/202; 439/511; 439/723; 439/724; 439/810

(58) Field of Search ..... 200/284, 293–296, 200/303–305, 50.32; 335/202; 361/634, 637, 673; 439/511, 801, 723–724, 810–814

(56) References Cited

U.S. PATENT DOCUMENTS 5,094,626 A * 3/1992 Fabrizi et al. ..... 439/511
6,379,196 B1 * 4/2002 Greenberg et al. ..... 439/801
6,497,592 B1 * 12/2002 Beadle ..... 439/814
6,733,347 B2 * 5/2004 Palet Mercader et al. .. 439/810

FOREIGN PATENT DOCUMENTS

| | | |
|---|---|---|
| DE | 84 34 232 | 12/1989 |
| EP | 0 588 712 | 3/1994 |
| EP | 1 014 414 | 6/2000 |
| EP | 1 100 105 | 5/2001 |

* cited by examiner

*Primary Examiner*—Michael A. Friedhofer
(74) *Attorney, Agent, or Firm*—Oblon, Spivak, McClelland, Maier & Neustadt, P.C.

(57) ABSTRACT

A protection and control assembly includes several multi-pole electrical switch devices each having a box (10,20,30) provided with input side and output side conducting connection strips, that project along a vertical axis on a horizontal connection area on the input side, and output side respectively, of the box (10,20,30) and that can be inserted in openings (44) of removable power terminal blocks (40, 40',50,50',60). The assembly includes at least one connecting element (80,80') that electrically connects the poles of a first and a second electrical device of the assembly, the connecting element (80) being arranged such that it is positioned firstly between the box (10) and a power terminal block (40,50) of the first device, and secondly between the box (20) and a removable power terminal block (40',50') of the second electrical device.

10 Claims, 4 Drawing Sheets

Figure 2:
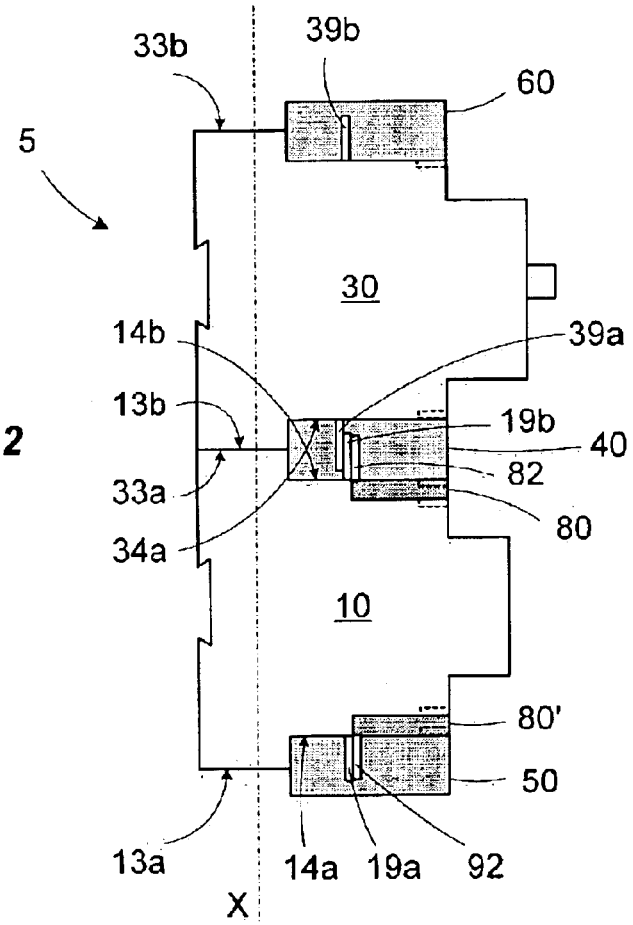

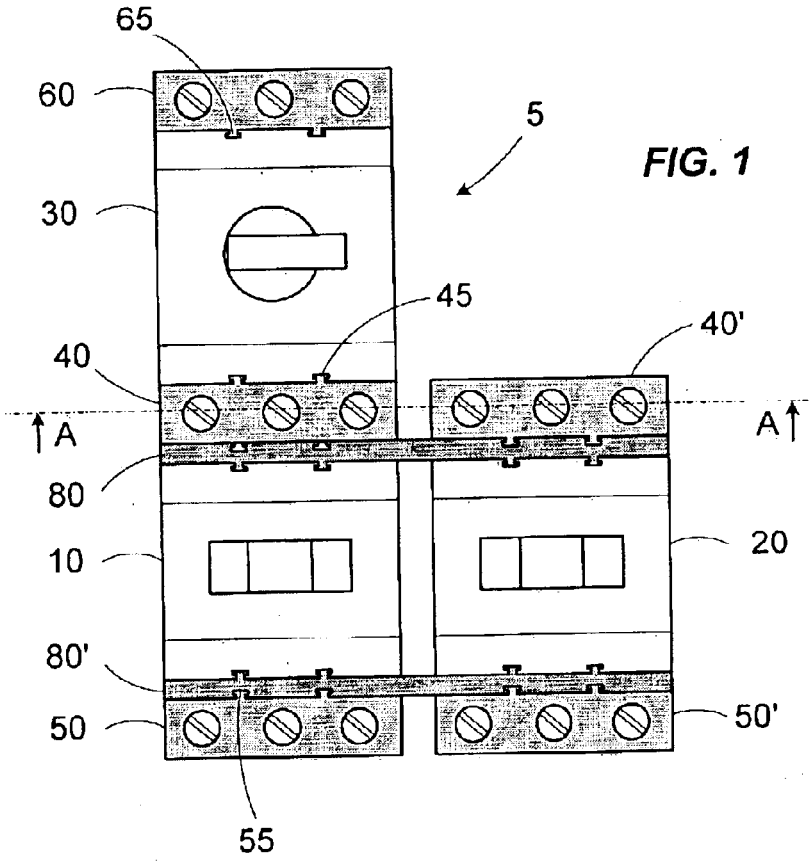
FIG. 1
FIG. 5
A-A
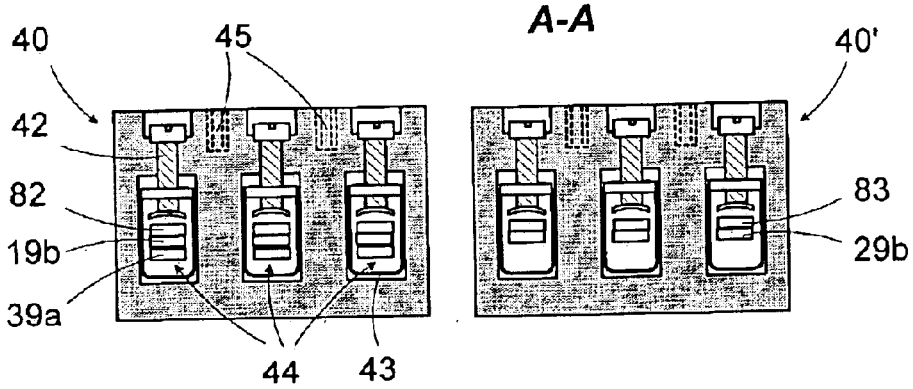
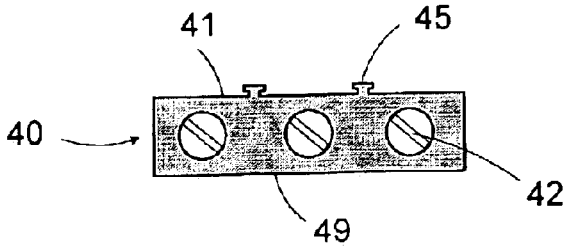
FIG. 6

ELECTROMAGNETIC PROTECTION AND CONTROL ASSEMBLY

This invention relates to an electromagnetic protection and control assembly enabling the combined use of several multipole electrical switch devices, particularly for making an assembly comprising several electrical devices such as a contactor, a circuit breaker, or any other similar electrical device that can be used for low voltage electrical distribution or control. The invention also relates to an electrical device that could be used in the composition of such a protection and control assembly.

In an assembly intended for the protection and control of an electrical motor (usually called a "motor start assembly") or any other low voltage multipole electrical load, an electrical protection device such as a circuit breaker or a fused isolating switch is frequently used in cascade with an electrical control device such as a contactor. Other devices such as a thermal protection relay can also be added to this combination. It may also be desirable to combine several control devices in the same motor start assembly so as to create a logical function, and particularly an inverter function.

It is more and more desirable to install such a motor start assembly as simply and quickly as possible, while maintaining a reliable connection. For obvious reasons of cost and time saving during assembly/wiring and space saving in electrical boxes or cabinets in which the assembly is installed, an attempt is made particularly to eliminate any conductors (wires, bars) forming connections between the devices to minimise the number of electrical connections to be made and to minimise the total size of the different associated devices. Furthermore, the installed assembly must maintain easy access for the connection of its power terminal blocks with external conductors such as cables or bars.

Document EP1100105 describes a device for prewiring between two multipole contactors. It includes proposals for input side and output side prewiring modules so that a given logical function can be made quickly between the two contactors. In this document, the input side modules are positioned on the input side of the input side power terminal blocks and output side modules are positioned on the output side of the output power terminal blocks of the devices. Consequently, the modules hinder access to power terminal blocks for the insertion of external conductors, particularly in the case of devices with high electrical power necessitating external conductors with a large cross-section, for example with an electrical current equal to or more than 32 A at 400V. Furthermore, if it is required to add an additional electrical device, for example a circuit breaker on the input side of the two contactors or a thermal relay on the output side of the two contactors, this solution always requires the use of two power terminal blocks per device.

Therefore, the purpose of the invention is to facilitate placement of an electrical combination of several electrical devices in order to make a simple, reliable and economic connection of a protection and control assembly and facilitating a logical function.

To achieve this, the invention describes a protection and control assembly comprising several multipole electrical switch devices each having a box provided with input side and output side conducting connection strips that project from a horizontal connection area on the input side, and output side respectively, of the box along a vertical axis and that can be inserted in openings of removable power terminal blocks. The assembly comprises at least one connecting element that electrically connects the poles of a first and a second electrical device of the assembly, the connecting element being arranged such that it is positioned firstly between the box and a removable power terminal block of the first electrical device, and secondly between the box and a removable power terminal block of the second electrical device.

According to one feature, each connecting element comprises first connection pins, connected to second connection pins. These connection pins project along the vertical axis and can be inserted into openings in the removable power terminal blocks. The connection pins in one connecting element are forced into contact with the connection strips of the boxes of the electrical devices.

According to another special feature, the connecting element is provided with support devices capable of co-operating with complementary means arranged in the boxes of the electrical devices. The support devices are preferably composed of one or several pins arranged on at least one horizontal face of the connecting element.

According to another special feature, the assembly comprises an input side connecting element, the first pins of which are in contact with the input side connection strips of the box of the first electrical device and the second pins of which are in contact with the input side connection strips of the box of the second electrical device. The assembly also comprises an output side connecting element in which the first pins are in contact with the output side connection strips of the box of the first electrical device and of which second pins are in contact with the output side connection strips of the box of the second electrical device. To make an inverter function, the input side connecting element connecting the input side connection strips of the boxes of the two three pole electrical devices internally performs an inversion function of the two poles of the electrical devices.

According to another special feature, the invention describes an assembly comprising a serial connecting element in which the first pins are in contact with the output side connection strips of the box of a first electrical device, and the second pins are in contact with the input side connection strips of the box of a second electrical device, placed at the side of the first electrical device.

Another purpose of the invention is to propose an electrical switch device that can be integrated in a protection and control assembly like that described in the invention. This device comprises a box provided with conducting connection strips on the input and output sides, that project along a vertical axis onto a horizontal connection area on the input and output sides respectively of the box and that can be inserted in the openings of the removable power terminal blocks.

Figure 3:
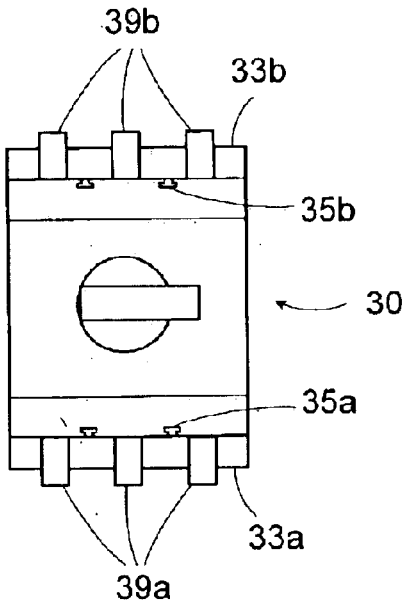
Figure 4:
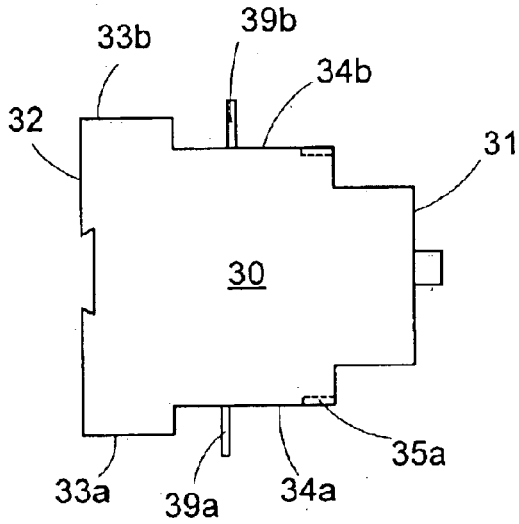

Other characteristics and advantages will appear in the detailed description given below with reference to an embodiment given as an example and shown in the attached drawings in which:

FIG. 1 diagrammatically shows a front view of an example of a protection and control assembly including three electrical devices, FIG. 2 shows the side view of the example in FIG. 1, which also shows connection strips of the electrical devices and the pins in the connecting elements, FIG. 3 shows a front view of a box of an electrical switch device used in the composition of an assembly according to FIG. 1, FIG. 4 shows a side view of the box in FIG. 3, FIG. 5 shows details of two removable terminal blocks according to section A—A in FIG. 1, FIG. 6 shows a front view of one of the terminal blocks in FIG. 5.

Figure 8:
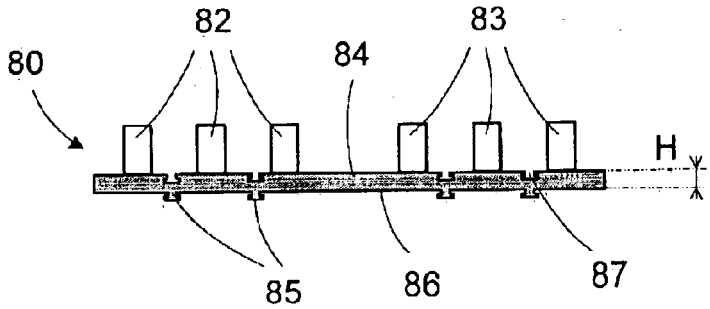
Figure 9:
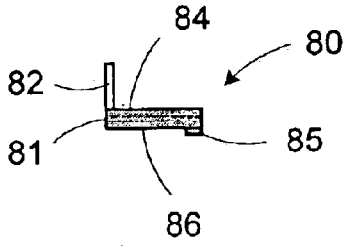
Figure 7:
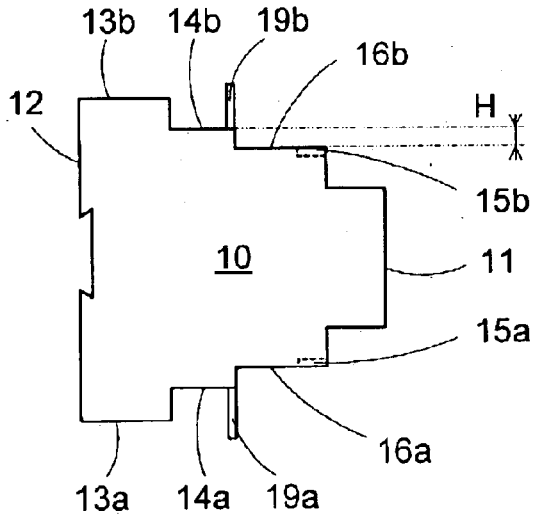
Figure 10:
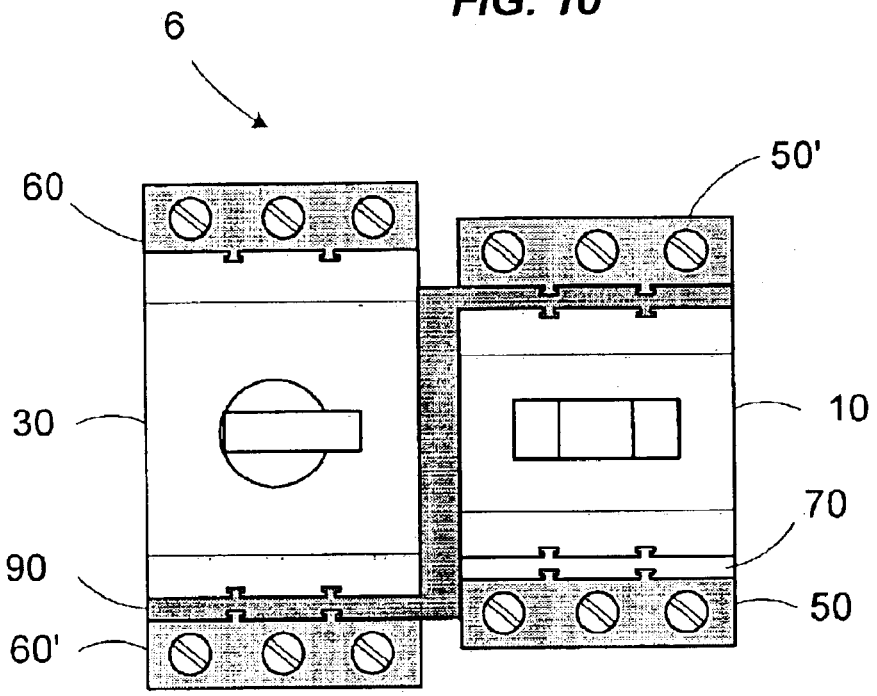
Figure 11:
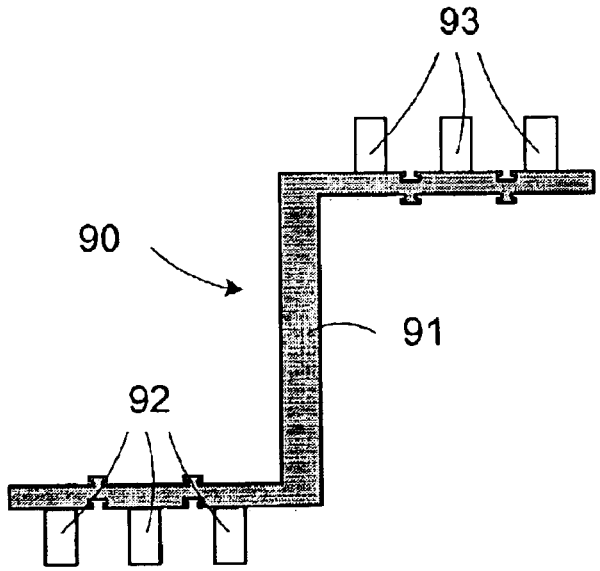

FIG. 7 shows a side view of a box of another electrical device used in the composition of an assembly according to FIG. 1, FIG. 8 shows details of a front view of a connecting element present in the assembly in FIG. 1, FIG. 9 shows a side view of the connecting element in FIG. 8, FIG. 10 diagrammatically shows a front view of another example of a protection and control assembly comprising two electrical devices, FIG. 11 shows the details of the connecting element present in FIG. 10.

FIGS. 1 and 2 show an example embodiment of a protection and control assembly according to the invention. This assembly comprises three electrical devices, in this case a circuit breaker 30 and two contactors 10,20. Similarly, the invention can be used to make an assembly also comprising for example a thermal relay on the output side of one of the contactors. It is also clear that the invention could also be applicable to any other electrical device that could be used for low voltage electrical distribution or control.

FIGS. 3 and 4 show a multipole electrical switch device, for example of the circuit breaker type, comprising a box 30 that can be integrated into such a protection and control assembly. FIG. 7 shows another multipole electrical device, for example of the contactor type, comprising a box 10 and that can also be integrated in such a protection and control assembly.

Each box 10 and 30 has a globally parallelepiped shape with front panels 11 and 31 respectively, that can include a manoeuvring device opposite the back faces 12 and 32 respectively, and that can include means of fastening the device on a frame, a section and/or a board. Each box 10 and 30 is provided with an approximately horizontal output side face 13*b*,14*b* and 33*b*,34*b* respectively, opposite an approximately horizontal output side face 13*a*,14*a*, or 33*a*,34*a* respectively. Conducting connection strips on the input side 19*b* and 39*b* project on the input side faces 13*b*,14*b* and 33*b*,34*b* respectively of the boxes 10 and 30 respectively, along a vertical axis X. Conducting output side connection strips 19*a* and 39*a* project on the output side faces 13*a*,14*a* and 33*a*,34*a* respectively of the boxes 10 and 30 respectively, along the same vertical axis X, but in the opposite direction.

Obviously, an input side connection strip and a corresponding output side connection strip correspond to each pole of the switch device, and will be used to carry electrical current into and out of this pole. The examples shown in FIGS. 3, 4 and 7 contain three input side and three output side connection strips, thus diagrammatically representing three-pole devices. In one preferred embodiment of the invention, the switch devices are provided with rigid conducting strips 19*a*,19*b* and 39*a*,39*b*, with an identical rectangular cross section sufficiently large for the circulation of a high power current, for example equal to or greater than 32 A at 400V. The conducting strips are normally made of metal, and particularly copper.

Preferably, the horizontal output side face 13*a*,14*a* and 33*a*,34*a* and the horizontal input side face 13*b*,14*b*, and 33*b*,34*b* respectively, of a box 10, and 30 respectively, are formed by several horizontal planes offset from each other. Thus, the horizontal output side face is composed of at least one approximately horizontal output side support area 13*a*, and 33*a* respectively, and an offset approximately horizontal output side connection area 14*a*, and 34*a* respectively. The output side conducting strips 19*a*, and 39*a* respectively, project from the output side connection areas 14*a*, and 34*a* respectively. Similarly, the approximately horizontal input side face is composed of an approximately horizontal input side support area 13*b*, and 33*b* respectively, and an offset horizontal output side connection area 14*b*, and 34*b* respectively. The input side conducting strips 19*b*, and 39*b* respectively, project from the input side connection areas 14*b*, and 34*b* respectively. The output side support areas 13*a*, and 33*a* respectively, and the input side support areas 13*b*, and 33*b* respectively, are closer to the back face 12, and 32 respectively, of the box 10, and 30 respectively, and the distance between them is greater than the distance between the output side connection areas 14*a*, and 34*a* respectively, and the input side connection areas 14*b*, and 34*b* respectively.

The output side and input side connection areas of the boxes 10,30 are arranged so that a removable power terminal block 40 can be placed in each of them, so as to enable an electrical connection between the connection strips 19*a*,19*b*, 39*a*,39*b* and the outside conductors. Obviously, the number of power terminals in this type of power terminal block 40, shown in FIGS. 5 and 6, is the same as the number of poles in the switch device on which it will be installed. It is parallelepiped shaped with two opposite horizontal faces 41,49 and a vertical front face through which the terminal clamping screws 42 are accessed. For each terminal in the power terminal block 40, there is a vertical opening 44 through which the horizontal faces 41,49 pass through which one or several electrical conductors can pass perpendicular to the line of the screws 42. The width of a terminal block 40 is approximately equal to the width of the boxes 10,30.

Thus, each connection strip 19*a*, 19*b* and 39*a*,39*b* is inserted in a corresponding opening 44 when one of the horizontal faces 41,49 of a connection terminal block 40 is in contact with a connection area 14*a*,14*b* and 34*a*,34*b* respectively of a box 10 and 30 respectively. Conventionally, each terminal of a power terminal block 40 comprises a clamping screw 42 that cooperates with a clamping cage 43 located in the corresponding opening 44 in the terminal. When the screw 42 is tightened, the cage 43 is deformed so that it clamps the conductors present in the opening 44. This clamping makes an efficient electrical connection between the connection strip and any other conductor that is already inserted in the opening 44, and also fixes the connection terminal block 40 to the box of the switch device.

Furthermore, at least one of the horizontal faces 41,49 of the power terminal block 40 is provided with support devices 45, to facilitate guidance, positioning and support of power terminals 40 on the box 30 of the electrical device. These support devices 45 are designed so that they can cooperate with complementary means on the output side 15*a* and 35*a* and the input side 15*b* and 35*b*, arranged on the output side connection areas 14*a* and 34*a* respectively, and the input side of connection areas 14*b* and 34*b* respectively, of the box.

According to one preferred embodiment, these support devices consist of one or several pins 45 present on a front part of the horizontal face 41 of the power terminal block 40. When the power terminal block 40 is installed in contact with a box 10,30 of a device, these pins are inserted in the corresponding number of cavities 15*a*,15*b* and 35*a*,35*b* present on the front part of the connection areas 14*a*,14*b* and 34*a*,34*b* respectively, of the box. Preferably, the shape of the cavities 15*a*,15*b*,35*a*,35*b* is complementary to the shape of the pins 45. Once the connection strips have been engaged in the openings 44 and before the screws 42 have been tightened, the terminal block 40 is put into its permanent position by sliding the horizontal face 41 backwards along the connection area 14*a*,14*b*,34*a*,34*b* until it stops in contact with the support area 13*a*,13*b*,33*a*,33*b*. During this operation, the pins 45 are engaged in the corresponding cavities 15*a*,15*b*,35*a*,35*b* contributing to holding the terminal block in place and positioning it adjacent to the box 10,30.

The removable power terminal block 40 is advantageously symmetric about a vertical median plane so that a single terminal block 40 can be installed indifferently on the output side or the input side of the boxes after turning around. In the examples given, the horizontal face 41 is provided with two pins 45 located on each side of the vertical median plane.

Furthermore, the box 10 shown in FIG. 7 also comprises a setback with a height H by construction over the front part of the horizontal output side connection areas 14*a* and the horizontal input side connection areas 14*b*, in front of the outputs from the output side connection strips 19*a* and the input side connection strips 19*b*. The connection strips are then preferably flush with the setback. This setback forms horizontal output side 16*a* and input side 16*b* connection areas. Therefore these output side connection areas 16*a* and input side connection areas 16*b* are further from the back face of the box 10 and closer to each other than the output side connection areas 14*a* and the input side connection areas 14*b*. In this case, the output cavity 15*a* and the input cavity 15*b* are placed in front of the output connection areas 16*a* and the input connection areas 16*b* of box 10, so that the support pins belonging to connecting elements or shims can fit into them.

This setback is used to insert a multipole connecting element 80 like that shown diagrammatically in FIGS. 8 and 9. A connecting element 80 is composed of a part made of a parallelepiped-shaped insulating material. It is provided with two opposite horizontal faces 84,86 and a back face 81. The first and second conducting connection strips 82 and 83, that may have a section similar to the connection strips 19 of the boxes, exit perpendicularly to the first horizontal face 84 along the vertical X axis along the same direction. The connecting element 80 on the front of the second horizontal face 86 comprises support pins 85 that can co-operate with cavities 15*a*,15*b*,25*a*,25*b* in the box 10,20. The connecting element 80 on the front part of the first horizontal face 84 comprises cavities 87 that can co-operate with the pins 45,45' in the power terminal blocks 40,40'.

Therefore, in the case of three-pole devices, the first pins 82 and the second pins 83 each comprise three distinct pins. The first pins 82 inside a connecting element 80 are electrically connected individually to the second pins 83 either directly pole by pole, or differently depending on the required logical function (see later).

The height H of a connecting element 80 (FIG. 8) is approximately equal to the height H of the setback corresponding to the setback between a connection area 14*a*,14*b* and a connection area 16*a*,16*b* (FIG. 7). Similarly, the depth of a connecting element 80 is approximately equal to the depth of a connection area 16*a*,16*b*. Therefore, the connecting element 80 can be inserted between the box of an electrical device and a removable power terminal block. Thus, when the second horizontal face 86 of a connecting element is positioned on a connection area 16*a*,16*b*, this connecting element 80 completely occupies the space created by the setback such that its first horizontal face 84 is at the same horizontal level as the connection area 14*a*,14*b*, thus it does not hinder placement of a power terminal 40, but does contribute to holding it in place.

Furthermore, the pins 82,83 are preferably flush with the back face 81 of the connecting element 80 as shown on FIGS. 2 and 9, such that when a connecting element 80 is positioned in the assembly, the pins 82,83 can be brought into contact in front of the connection strips 19*a*,19*b*,29*a*, 29*b*. The pins and connection strips in contact will then be held in place by clamping in openings 44 in the power terminal blocks 40.

When there is no connecting element 80 to be positioned on a connection area 16*a*,16*b* of a box 10, the space created by the setback between the connection areas and the connection areas can then easily be filled by a shim 70 (see FIG. 10) with an appropriate dimension, in other words a height H, a depth equal to the depth of the connection area and a width approximately equal to the width of the box 10, to improve the support of a power terminal block on the box.

A protection and control device 5 shown in FIGS. 1 and 2 comprises three electrical switch devices. The purpose of this assembly 5 is to create a motor start assembly capable of easily supplying a logical function such as an inverter function (inversion of the running direction of the motor), a speed selection function (LS/HS (low speed/high speed) switching), a star-delta start function, or other functions, without any additional wiring.

A first device comprising a box 10, and a second device comprising a box 20 identical to box 10, are of the contactor type. A third device comprising a box 30 is of the circuit breaker type. The first device and the second device are arranged one at the side of the other in the same horizontal plane. They may be placed adjacent to each other, or preferably at a slight spacing from each other so that a mechanical locking module can be inserted between the two that can be used particularly in the case of an inverter function. The third device is arranged in a vertical plane above either one or the other of the two first devices.

In the assembly 5, the box 30 is placed adjacent on box 10 (but it could also be on box 20) along a direction parallel to the vertical X axis of the connection strips such that the output side connection area 33*a* of the box 30 is in contact with the input side support area 13*b* of the box 10. Therefore the vertical dimension of the assembly 5 is minimum because the boxes of the electrical devices 10,30 are placed directly one on the other without any space between them.

A removable input side power terminal block 60 on the input side of the assembly 5 is installed in contact with the input side connection area 34*b* of the box 30 of the third device. Tightening the screws of the input side terminal block 60 fixes the terminal block in contact with the box 30 and makes electrical connections between the input side connection strips 39*b* and the input side external conductors. Similarly, on the output side of the assembly 5, two removable output side power terminal blocks 50,50' are installed in contact with the output side connection areas 14*a* and 24 respectively, of boxes 10 and 20 respectively. Tightening the screws on these output side terminal blocks 50 and 50' fixes them in contact with the boxes 10 and 20 respectively, and makes the electrical connection between their output side connection strips and external output side conductors. Furthermore, a power terminal block 40' is placed on the input side of the box 20 of the second device.

The offset between the support area and the connection area of the same horizontal face of all boxes is designed such that when the box 30 of the third device is placed on top of the box 10 of the first device through their support area, the space existing between the output side connection area 34*a* of box 30 and the input side connection area 14*b* of box 10 can be used to house a removable power terminal block 40 common to the boxes 30 and 10. The support pins 45 of this common power terminal block 40 are associated indifferently either with cavities 35*a*,35*b* of box 30, or with cavities 15*a*,15*b* of box 10. This common terminal block 40 makes an electrical connection between the output side connection strips 39*a* of the box 30 with the input side connection strips 19*b* of the box 10, and can also attach the boxes 30 and 10 to each other.

To make this electrical connection efficiently, the output side connection strips 39*a* of the box 30 in the third device are slightly offset with respect to the input side strips 19*b* of the box 10 of the first device along a direction perpendicular to the vertical X axis of the connection strips. In the examples shown in the diagrams, the output side connection strips 39*a* of the box 30 are offset backwards from the input side connection strips 19*b* of box 10 (see FIG. 2). This offset is sufficient to not hinder bringing the boxes 10 and 30 adjacent to each other when installing the assembly 5, but nevertheless, once the screws 42 of the common terminal block 40 are tight, they enable the output side connection strips 39*a* of the third device to overlap and be flush with the input side connection strips 19*b* of the first device so as to form a sufficient electrical contact area, compatible with the electrical current likely to circulate in the protection and control assembly 5.

Advantageously, the common terminal block 40 and the power terminal blocks 40',50,50' and 60 are all identical to the removable power terminal block 40 described above. This thus reduces the number of different parts necessary to install the assembly 5, since all power terminal blocks are interchangeable with each other. They include support pins 45,55,65 that co-operate with complementary shape cavities in boxes 10,20,30 so as to facilitate guidance, positioning and support of the terminal blocks in contact with the boxes of the electrical devices.

In assembly 5 in FIGS. 1 and 2, the boxes 10 and 20 are connected to each other through a multipole input side connecting element 80 and output side connecting element 80', for example so as to make an inverter function. The input side connecting element 80 is inserted in the input side connection areas of the boxes 10 and 20 such that the first pins 82 of the input side connecting element 80 are in contact with the input side connection strips 19*b* of box 10 and the second pins 83 of the input side connecting element 80 are in contact with the input side connection strips 29*b* of the box 20. Therefore, in accordance with FIGS. 2 and 5, the common terminal block 40 is a means of clamping the pins 82, the input side connection strips 19*b* of the box 10 and the output side connection strips 39*a* of the box 30, to each other. The terminal block 40' clamps all pins 83 and input side connection strips 29*b* of the box 20 to each other.

The output side connecting element 80' is inserted in the output side connection areas of the boxes 10 and 20. Therefore, the first pins of the output side connecting element 80' are in contact with the output side connection strips 19*a* of the box 10 and are clamped together by terminal block 50. The second pins of the output side connecting element 80' are in contact with the output side connection strips 29*a* of the box 20 and are clamped together by terminal block 50'.

The internal wiring of the connection pins inside the connecting elements 80,80' is a means of performing a logical function. For an inverter function made with three-pole devices, the input side connecting element 80 comprises a first pole of the first pins 82 that is connected internally to the same corresponding pole of the second pins 83, while the other two poles of the first pins 82 are connected internally in an inverted manner to the corresponding poles of the second pins 83. On the other hand, the poles of the first and second pins of the output side connecting element 80' are connected internally directly one by one.

Due to this advantageous arrangement of connecting elements 80,80', the assembly 5 is extremely simple to make and is not any larger (c/c distance, height, depth) than a standard assembly with three electrical devices that does not contain such connecting elements. Therefore, the assembly 5 can easily be integrated into an existing box or cabinet with other electrical devices.

It would also be possible to imagine a protection and control assembly similar to assembly 5, but comprising only one input side connecting element 80, in which the pins 82,83 are directly connected internally pole to pole without any output side connecting element 80'. This assembly can then be used to supply power to two contactors 10,20 starting from the same input side circuit breaker 30, for example for use in LS/HS switching. The missing output side connecting element 80' may be replaced by two shims 70 between the box 20 and the terminal block 50, and between the box 30 and the terminal block 50'.

FIG. 10 shows another example of a protection and control assembly according to the invention. This assembly 6 comprises a first device 30, for example a circuit breaker type of device, and a second device 10, for example a contactor type device, placed at the side of the first device 10. The assembly 6 comprises an input side removable terminal block 60 used to connect the input side connection strips 39*b* on the box 30 of the first device with external input side conductors. The assembly 6 also comprises an output side removable terminal block used to connect the output side connection strips 19*a* of the box 10 of the second device with output side external conductors. The boxes 10 and 30 are electrically connected to each other through an S-shaped serial connecting element 90 (see FIG. 11), comprising a central part 91 located between two horizontal parts from which the first connection pins 92 and second connection pins 93 project along a vertical axis but in an opposite direction. The pins 92 and 93 are connected to each other directly pole by pole inside this element 90.

The first pins 92 are kept in contact with the output side connection strips 39*a* of box 30 by means of a removable terminal block 60' and the second pins 93 are held in contact with the input side connection strips 19*b* of the box 10 by means of a removable terminal block 50'. The power terminal blocks 50,50',60,60' are identical and interchangeable. Thus, the assembly 6 is used to quickly make a series combination of two electrical devices (for example a circuit breaker/contactor) located adjacent to each other Without necessitating any particular wiring. The boxes 10 and 30 are not in contact with each other, so that the central part 91 of the connecting element 90 can be inserted between the two. The width of the central part 91 may for example be approximately equal to the width of a mechanical locking module that can be used between two contactors, so as to standardise the spacings between two electrical devices located adjacent to each other.

Advantageously, this arrangement facilitates connection and assembly of the assembly 6, even when the boxes 10 and 30 of the devices are previously installed on their support, frame, section or board. The connecting element 90 can then be installed through the front face of the assembly and brought into position by means of the support pins, before the different power terminal blocks are put into position and screwed together to obtain the assembly 6.

Obviously, it would be possible to imagine other variants and improvements to details, and even to envisage the use of equivalent means, without going outside the scope of the invention.

What is claimed is:

1. Protection and control assembly comprising several multipole electrical switch devices each having a box (10, 20,30) provided with input side (19*b*,29*b*,39*b*) and output side (19*a*,29*a*,39*a*) conducting connection strips that project from a horizontal connection area on the input side (14*b*, 24*b*,34*b*), and output side (14*a*,24*a*,34*a*) respectively, of the box (10,20,30) along a vertical axis (X) and that can be inserted in openings (44) of removable power terminal blocks (40,40',50,50',60), characterised in that the assembly comprises at least one connecting element (80) that electrically connects the poles of a first and a second electrical device of the assembly, the connecting element (80) being arranged such that the connecting element is positioned firstly between the box (10) and the removable power terminal block (40,50) of the first electrical device, and secondly between the box (20) and the removable power terminal block (40',50') of the second electrical device.

2. Protection and control assembly according to claim 1, characterised in that the at least one connecting element (80) comprises first connection pins (82) connected to second connection pins (83) that project along the vertical axis (X) and that can be inserted in the opening (44) of the removable power terminal blocks.

3. Protection and control assembly according to claim 2, characterised in that the connection pins (82,83) of a the at least one connecting element (80) are in contact against the connection strips of the electrical device boxes.

4. Protection and control assembly according to claim 2, characterised in that the at least one connecting element (80) has support devices (85) that can cooperate with complementary means (15*a*,15*b*,25*a*,25*b*) arranged in the boxes (10,20) of the electrical devices.

5. Protection and control assembly according to claim 4, characterised in that the support devices consist of one or several pins (85,86) arranged on at least one horizontal face (81) of the at least one connecting element (80).

6. Protection and control device according to claim 2, characterised in that the assembly comprises an input side connecting element (80), the first pins (82) of which are in contact with the input side connection strips (19*b*) of the box (10) of the first electrical device and the second pins (83) of which are in contact with the input side connection strips (29*b*) of the box (20) of the second electrical device.

7. Protection and control assembly according to claim 6, characterised in that the assembly comprises an output side connecting element (80') in which the first pins are in contact with the output side connection strips (19*a*) of the box (10) of the first electrical device and the second pins are in contact with the output side connection strips (29*a*) of the box (20) of the second electrical device.

8. Protection and control assembly according to claim 7, characterised in that the input side connecting element (80) connecting the input side connection strips (19*b*,29*b*) of the boxes (10,20) of the two multipole electrical devices internally performs an inversion function of two poles of the electrical devices.

9. Protection and control assembly according to claim 2, characterised in that the assembly comprises a serial connecting element (90) in which the first pins (92) are in contact with the output side connection strips (39*a*) of the box (30) of a first electrical device, and the second pins (93) are in contact with the input side connection strips (19*b*) of the box (10) of a second electrical device, placed at the side of the first electrical device.

10. Electrical switch device comprising a box (10) provided with input side (19*b*) and output side (19*a*) conducting connection strips that project along a vertical axis (X) onto a horizontal connection area on the input side (14*b*), and output side (14*a*) respectively, of the box (10) and that can be inserted in openings (44) of removable power terminal blocks (40), characterised in that the electrical device is capable of being integrated in a protection and control assembly according to one of the preceding claims.

* * * * *